US006199618B1

(12) United States Patent
Fenne et al.

(10) Patent No.: US 6,199,618 B1
(45) Date of Patent: Mar. 13, 2001

(54) METHOD OF PRODUCING CASTINGS

(76) Inventors: Michael Fenne, Dellbusch 169, 42279 Wuppertal; Oswald Holtz, Friedrich-Silcher-Weg 4, 35279 Neustadt, both of (DE)

( * ) Notice: Subject to any disclaimer, the term of this patent is extended or adjusted under 35 U.S.C. 154(b) by 0 days.

(21) Appl. No.: 09/242,148

(22) PCT Filed: Aug. 6, 1997

(86) PCT No.: PCT/EP97/04296

§ 371 Date: Feb. 9, 1999

§ 102(e) Date: Feb. 9, 1999

(87) PCT Pub. No.: WO98/06524

PCT Pub. Date: Feb. 19, 1998

(30) Foreign Application Priority Data

Aug. 9, 1996 (DE) ..... 196 32 195

(51) Int. Cl.[7] ..... B22D 27/04

(52) U.S. Cl. ..... 164/122; 164/124; 164/125; 148/543; 148/545

(58) Field of Search ..... 164/122, 124, 164/125, 4.1, 130; 148/543, 545

(56) References Cited

U.S. PATENT DOCUMENTS

| | | | | |
|---|---|---|---|---|
| 2,019,480 | * | 11/1935 | Campbell | 148/545 X |
| 4,769,092 | | 9/1988 | Peichl et al. | 148/644 |
| 4,990,194 | * | 2/1991 | Obata et al. | 148/543 |

FOREIGN PATENT DOCUMENTS

| | | | | |
|---|---|---|---|---|
| 2461293 | | 7/1976 | (DE) . | |
| 3442130 | | 5/1986 | (DE) . | |
| 0538575 | | 4/1993 | (EP) . | |
| 342334 | * | 1/1931 | (GB) | 148/543 |
| 5-104234 | * | 4/1993 | (JP) | 164/125 |

OTHER PUBLICATIONS

Patent Abstracts of Japan, vol. 013, No. 042 (C–564), Jan. 30, 1989 & JP 63–241112 A (Kawasaki Steel Corp), Oct. 6, 1988.

Mellon, Dale F., "Industrial Thermography", Sep. 1988, Advanced Materials & Processes Inc. Metal Process, Metals Park, Ohio US.

* cited by examiner

*Primary Examiner*—Harold Pyon
*Assistant Examiner*—I.-H. Lin
(74) *Attorney, Agent, or Firm*—Friedrich Kueffner

(57) ABSTRACT

In order to produce castings from cast iron with foliated graphite, the carbon content of the cast iron can be set at between approximately 3 and 4% by controlling the melting process of the type and/or operation of the melting furnace. The molten mass is then cast in a sand-casting or lost-form method. During conventional cooling, the known mechanical properties of the cooled cast are set. In order to improve these mechanical properties in terms of hardness and strength, the casting is released from its mold at a temperature ranging from 1,100° C. to 800° C. and is immediately subjected to a cooling treatment by being blasted with an air flow in order to cool it to below 723° C. in a given amount of time. The casting, in selected regions, is cooled to below 723° C. by specific intermittent bursts of air in a relatively short amount of time in order to produce a harder structure. The cooling treatment is stopped when the temperature at the eutectoid line of the iron-carbon diagram is reached.

9 Claims, 1 Drawing Sheet

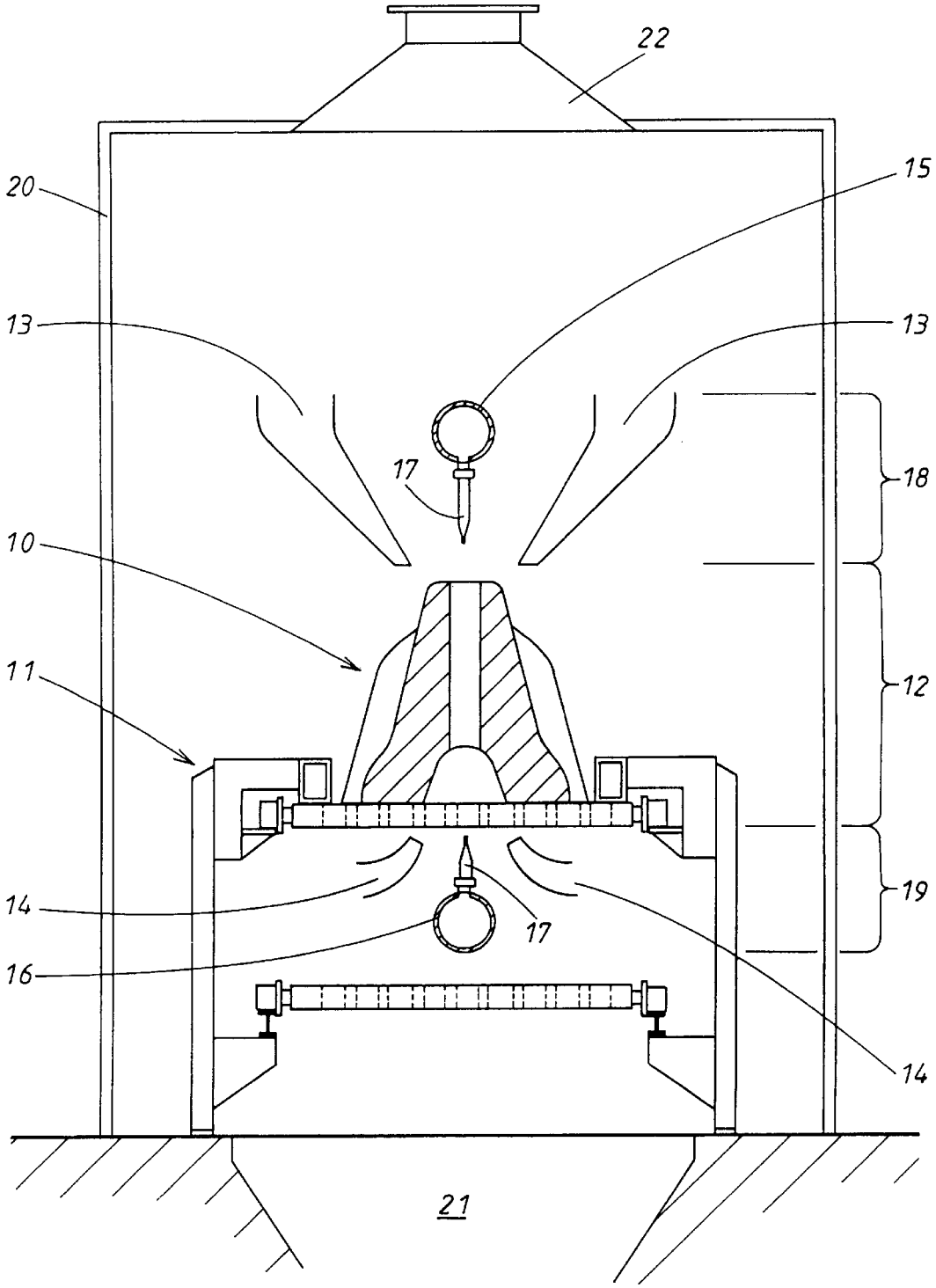
22
20
15
13
13
17
18
10
12
11
19
14
17
16
14
21

METHOD OF PRODUCING CASTINGS

BACKGROUND OF THE INVENTION

1. Field of the Invention

The invention pertains to a process for producing castings such as engine blocks, etc., out of cast iron with lamellar graphite.

2. Description of the Related Art

Castings find use in nearly every branch of industry such as in machine tool construction, in semi-finished products, in the construction of furnaces and heating systems, in engine construction, and finally also in the chemical industry. To save weight, it is desirable to produce castings with thin walls but still with sufficient strength, but this requires that the molten cast iron have good flow behavior. It is known that an elevated carbon content promotes the flowability of the molten cast iron. The carbon content of the cast iron can be controlled by the make-up of the charge and by the way in which the furnace is operated. Cast iron is usually melted in a cupola furnace. Nevertheless, the melting process can also be carried out in a rotary furnace or in an electric furnace. After the melt has been poured, the casting usually remains in the mold until it has cooled to about 300° C. The structural state achieved during this cooling process is usually accepted as is, even though it is known that effects can be exerted on the microstructural condition and thus on the mechanical properties of the casting by the use of certain cooling conditions. To achieve specific types of mechanical properties, it is conventional practice to produce alloyed cast iron by the addition of special additives such as copper, chromium, phosphorus, antimony, manganese, microalloys, etc.

For many types of castings, including especially the engine blocks of internal combustion engines, it is desirable for certain areas of the casting to be harder or to have higher strength values than other areas of the same casting.

SUMMARY OF THE DESCRIPTION

The task of the present invention is to produce castings with mechanical properties which, with respect to hardness and strength, can be influenced in a predetermined manner by the formation of appropriate microstructures. In accordance with the present invention, the carbon content of the cast iron is adjusted to approximately 3–4% carbon in the melt by control of the melting process through adjustments to the charge make-up and/or to the operation of the melting furnace. The melt is then poured into a mold in the sand-casting or lost-form method. The casting is removed from the mold at a temperature in the range of 1,100–800° C. Immediately afterward, the casting is subjected to a cooling treatment by a stream of air to remove all traces of mold material from the casting and selected areas of the casting are cooled to a point below the eutectoid range by short, aimed, intermittent blasts of air for obtaining improved mechanical properties. The cooling treatment is stopped after the temperature drops below the temperature of the eutectoid range. As a result of this treatment, there is no longer any need to add alloying materials to the charge or to the cast iron melt, because it is possible to give certain partial areas of the casting superior mechanical properties in the manner indicated without involving the entire casting. Thus, when the casting is machined later, only the areas which have the superior mechanical properties need to be cut with expensive tools. The other areas can be machined with simple, conventional tools. The increased hardness of certain areas of the cast iron is compensated by an increase in the carbon content to 3–4%, and preferably to a C content of 3.6–3.8%, which can be achieved by control of the melting process, i.e., by adjusting the make-up of the charge and/or the operation of the melting furnace and the subsequent pouring of the melt by the sand-casting or lost-form process. Thus the areas of the casting which have not been given extra hardness by additional intermittent air blasts can be machined in the simple, conventional way. Castings of through-alloyed cast iron or cast iron which has been hardened all the way through would be more expensive to machine as a result of the increased tool wear.

To eliminate internal stresses in the casting after the cooling treatment, it is advantageous, after the cooling treatment, to return the casting in steps to a small residual temperature in a holding furnace to avoid residual stresses.

To harden selected areas of the casting, separate blasts of air are directed onto the predetermined surface areas, these blasts being calculated in such a way as to produce a hardness of more than 220 HB. It is also preferable to calculate the cooling times of both the continuous, general air stream and the separate air blasts in such a way as to obtain a tensile strength of at least 250 N/mm$^2$. The amount of cooling air for the continuous, general air stream, the amount of air for the separate air blasts, and the cooling times can be determined on the basis of experience, that is, empirically. To standardize the process with respect to reproducibility, it is advantageous from an economic standpoint to use an EDP system including a camera and a monitor to control and to program the cooling treatment of the casting with respect to cooling intensity, the continuous air stream, and the pulsating, individually directable air blasts. For this purpose, it is preferable to position the castings on a continuous conveyor, so that they can pass through the treatment line where they are subjected to the continuous air stream and the intermittent air blasts. Although various methods for conducting the castings through the treatment section can be imagined, it is advantageous to use a continuous conveyor in the form of an apron conveyor with insertable retaining edges for holding the castings in position. At least the settings of the nozzles which deliver the air blasts should be adjustable, and they should be able to move along with the apron conveyor at the same rate of speed.

To avoid the waste of energy, it is advantageous for the air which has been heated during the cooling process to be used for heating purposes and/or for the preparation of hot water. The heated air is preferably sent to a heat exchanger.

BRIEF DESCRIPTION OF THE DRAWING

In the Drawing:

The single FIGURE of the drawing is an illustration of the plant used for carrying out the process according to the invention.

DESCRIPTION OF THE PREFERRED EMBODIMENTS

After a cast iron with lamellar graphite melt with a carbon content of approximately 3.4–4.0% has been produced with regulation of the silicon content e in a cupola, the melt is poured into a sand-casting mold or into a lostform mold to produce a casting, which can be, for example, an engine block. After the melt has been poured, the casting 10 is separated, loosened, or unpacked carefully from its mold and placed on a continuous conveyor 11. This continuous conveyor may be advantageously an apron conveyor, on the plates of which the casting is held in position by means of insertable retaining edges (not shown). As can be derived from the figure, the plates of continuous conveyor 11 and casting 10 together form a casting transport plane 12. Above this casting transport plane are permanently installed, strip-shaped cooling air feed funnels 13, extending over a considerable length of continuous conveyor 11. These funnels are directed toward casting 10 and subject it to a continuous stream of cooling air. Strip-shaped cooling air feed funnels 14 are installed permanently under the air-permeable plates of continuous conveyor 11, extending over the same length of the conveyor and also subject casting 10 to a continuous stream of cooling air. The amount of cooling air and the speed at which continuous conveyor 11 travels are designed so that, starting from the original temperature of casting 10, the casting is cooled down to at least 723° C. by the time it leaves the cooling section. High-pressure cooling lines 15, 16, which can be carried along at the transport speed of continuous conveyor 11 and can be aimed at casting 10, are provided both above and below casting 10. These lines have nozzles 17, through which intermittent blasts of cooling air are delivered onto certain areas of casting 10. These directed, intermittent blasts of compressed air not only increase the degree to which certain areas of the casting are cooled per unit time but also remove residues of the mold material, so that the casting has a uniformly smooth surface upon which the cooling process can act and the cooling air can impinge. Traveling high-pressure lines 15, 16 are controlled by marking the areas or parts of casting 10 to be treated on a screen, which displays the casting to be treated in three dimensions. In this way it is possible to program both the intensity of the cooling and the intensity of the pulsations. Stationary cooling air feed funnels 13 and traveling high-pressure cooling line 15 together form an upper cooling section 18, whereas cooling air feed funnels 14 and traveling high-pressure cooling line 16 together form a lower cooling section 19. The continuous cooling air supply is operated as a low-pressure cooling system, whereas the intermittent cooling air supply to certain areas of the casting is operated as a high-pressure cooling system. As soon as casting 10 to be treated enters the treatment zone, a camera recognizes the position of casting 10 and converts this into electronic data, on the basis of which the nozzles are brought into position facing the areas of the casting determined by the program.

The nozzles then produce the desired cooling effect in accordance with the intensity and duration of the high-pressure air stream, so that the treated surfaces of the casting reach a tensile strength of at least 250 N/mm$^2$. As a result of the aimed, pulse-like blasts of cooling air delivered by these nozzles, furthermore, a Brinell hardness of more than 220 HB is reached in the areas in question. After the casting has cooled to a point below the eutectoid line, the cooling process is stopped, and the casting is sent to a holding furnace to eliminate the residual stresses present in it. The heat of the furnace together with the residual heat of the casting reheats the casting so that the residual stresses are eliminated. The holding furnace is operated in such a way that the casting is cooled in a stepwise manner to about 300° C.

It is obvious that the cooling device is surrounded by a housing 20 and that the bottom of the cooling area has an opening 21 for disposal of the molding sand. In addition, one or more dust removal openings 22 are provided in the treatment zone of the cooling device; these openings can be connected to a dust removal system.

The exemplary embodiment described above explains the process only by way of example and can be modified as necessary to meet the concrete requirements.

What is claimed is:

1. A process for producing a casting from cast iron with lamellar graphite, the cast iron having a carbon content, the process comprising producing the cast iron from a melt obtained in a melting process in a melting furnace, adjusting the carbon content of the cast iron to approximately 3–4% carbon in the melt by controlling the melting process through adjustments in charge make-up and/or operation of the melting furnace, pouring the melt into a mold utilizing a sand-casting or lost-form method, removing the casting from the mold at a temperature in a range of 1,100–800° C., subjecting the casting immediately afterward to a cooling treatment by a continuous stream of air for removing all traces of mold material from the casting, cooling selected areas of the casting to a point below the eutectoid range by short, aimed, intermittent blasts of air for obtaining improved mechanical properties, and stopping the cooling treatment after the temperature drops below the temperature of the eutectoid range.

2. The process according to claim 1, comprising, following the cooling treatment, returning the casting in steps to a low residual temperature in a holding furnace to avoid residual stresses.

3. The process according to claim 1, comprising selecting the short intermittent blasts of air directed at selected areas of the casting to produce a hardness of more than 220 HB.

4. The process according to claim 1, comprising selecting cooling times of the continuous air stream and the short intermittent blasts of air for obtaining a tensile strength of at least 250 N/mm$^2$.

5. The process according to claim 1, comprising controlling and programming cooling intensities of the continuous air stream and the short intermittent blasts of air utilizing an electronic data processing unit comprised of a camera and a monitor.

6. The process according to claim 1, comprising positioning the casting to be cooled on a continuous conveyor and subjecting the casting to the continuous air stream and to the short intermittent blasts of air in the continuous conveyor.

7. The process according to claim 6, wherein the continuous conveyor is an apron conveyor with insertable retaining edges for holding the castings in position, further comprising delivering the continuous air stream and the short intermittent blasts of air through nozzles, further comprising controlling settings of at least the nozzles delivering the short intermittent blasts of air, and moving the nozzles along with the apron conveyor over certain distances and at an identical rate of speed as the apron conveyor.

8. The process according to claim 1, comprising utilizing air heated by the cooling treatment for heating purposes and/or for preparing hot water.

9. The process according to claim 8, wherein the heated air is fed to a heat exchanger.

* * * * *